United States Patent [19]

Chutter et al.

[11] Patent Number: 4,999,860

[45] Date of Patent: Mar. 19, 1991

[54] APPARATUS FOR GENERATING WAVES IN A SWIMMING POOL

[76] Inventors: Geoffrey P. Chutter; Andrew P. Wray, both of 202-8360 Bridgeport Road, Richmond, BC, Canada, V6X 3C7; Ian A. Wray, 234 Drumoyne Road, Glasgow, G51 4DY, Scotland

[21] Appl. No.: 316,095

[22] Filed: Feb. 27, 1989

[30] Foreign Application Priority Data

Mar. 8, 1985 [GB] United Kingdom ..... 8805480

[51] Int. Cl.[5] ..... E04H 3/18; E02H 3/00; A47K 3/10

[52] U.S. Cl. ..... 4/491; 405/79

[58] Field of Search ..... 4/491, 490; 137/872, 137/883; 405/79

[56] References Cited

U.S. PATENT DOCUMENTS

| | | | |
|---|---|---|---|
| 4,467,483 | 8/1984 | Bastenhof | 4/491 |
| 4,522,535 | 6/1985 | Bostenhof | 4/491 X |
| 4,539,719 | 9/1985 | Schuster et al. | 4/491 |
| 4,558,474 | 12/1985 | Bastenhof | 4/491 |
| 4,692,949 | 9/1987 | Dunn | 4/491 |
| 4,720,210 | 1/1988 | Stonor et al. | 4/491 X |
| 4,730,355 | 3/1988 | Kreinbih et al. | 405/79 X |
| 4,812,077 | 3/1989 | Raike | 4/491 X |

*Primary Examiner*—Henry K. Artis
*Attorney, Agent, or Firm*—Kareem M. Irfan

[57] ABSTRACT

Apparatus (10) for generating waves in a swimming pool comprises a plurality of wave generating chambers (11) each communicating with the pool through a below-the-water passageway (15) and having a closed upper portion (13) extending above the quiescent water level of the pool, each said upper portion (13) having first passageway means (16) connected via first fluid flow control means (17) to a pneumatic wave-generating medium (18) and second passageway means (19) connected via second fluid flow control means (20) to an aqueous wave generating medium (21), and operating means (30) connected to said first and second fluid flow control means (17, 20), said operating means (30) being arranged, in one mode, to cause intermitent delivery of said pneumatic wave-generating medium (18) to one of said chambers (11) to create a first wave-forming effect while simultaneously blocking delivery of said aqueous wave-generating medium (18) to said one chamber (11) and, in another mode, to cause delivery of said aqueous wave-forming medium to said one chamber (11) to create a second wave-forming effect while simultaneously both blocking delivery of said pneumatic wave generating medium (18) to said one chamber (11) and venting said one chamber (11).

15 Claims, 1 Drawing Sheet

APPARATUS FOR GENERATING WAVES IN A SWIMMING POOL

Figure 1:
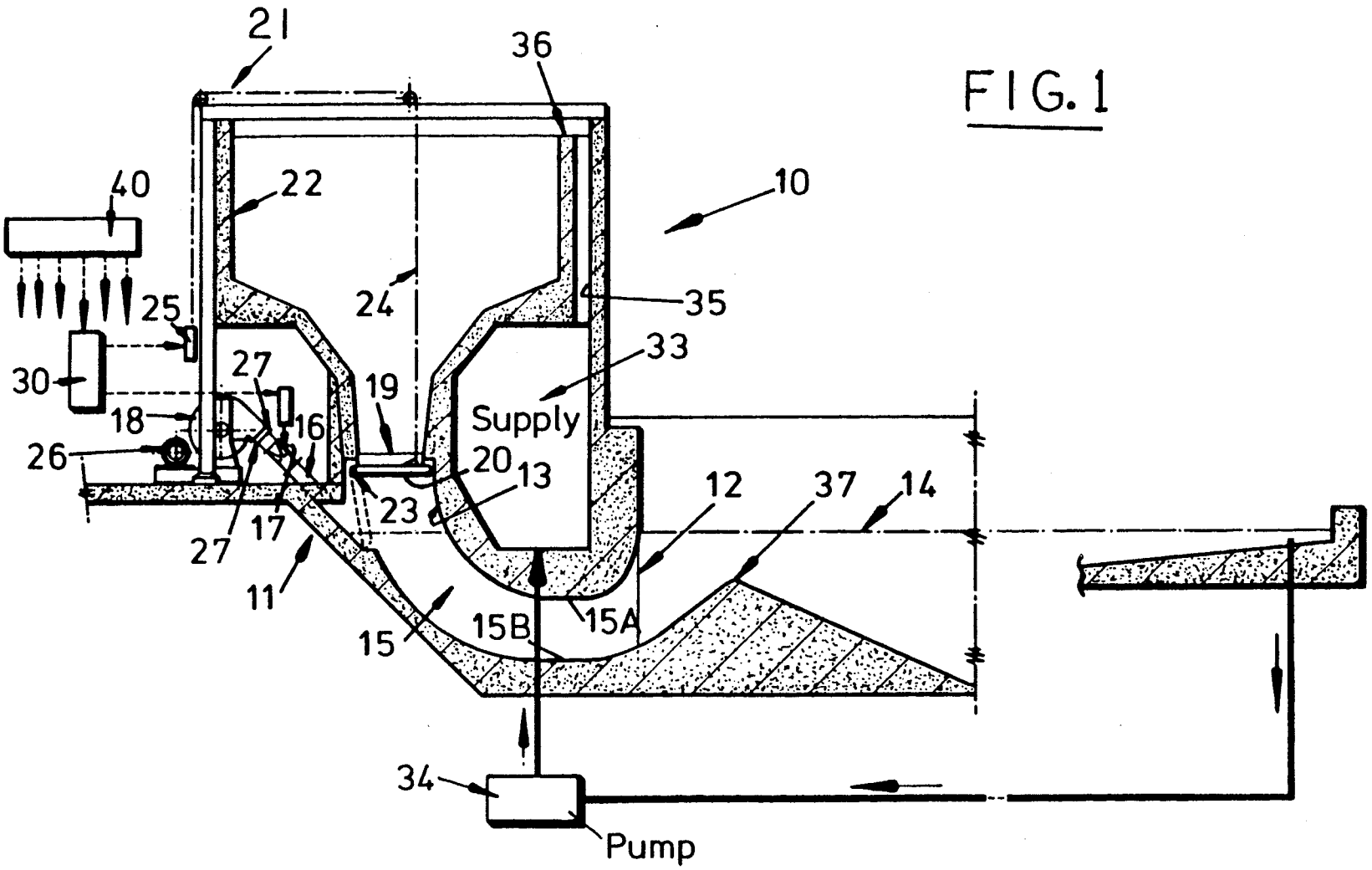

This invention relates to apparatus for generating waves in a swimming pool.

According to the present invention there is provided apparatus for generating waves in a swimming pool comprising a plurality of wave generating chambers each communicating with the pool through a below-the-water passageway and having a closed upper portion extending above the quiescent water level of the pool, each said upper portion having first passageway means connected via first fluid flow control means to a pneumatic wave-generating medium and second passageway means connected via second fluid flow control means to an aqueous wave generating medium, and operating means connected to said first and second fluid flow control means, said operating means being arranged, in one mode, to cause intermittent delivery of said pneumatic wave-generating medium to one of said chambers to create a first wave-forming effect while simultaneously blocking delivery of said aqueous wave-generating medium to said one chamber and, in another mode, to cause delivery of said aqueous wave-forming medium to said one chamber to create a second wave-forming effect while both blocking delivery of said pneumatic wave generating medium to said one chamber and venting said one chamber.

The pneumatic wave-generating medium may comprise a separate source of pressurised air for each chamber, a single source of pressurised air for all chambers, or a plurality of sources of pressurised air each connected to deliver to more than one chamber.

The first passageway means may comprise a single aperture in which case the pertaining first fluid flow control means is adapted to control flow of air both into and out of the chamber via the single aperture. Alternatively the first passageway means may comprise a pair of apertures in which case the first fluid flow control means is adapted to control flow of air into the chamber through one of the apertures and to control flow of air out of the chamber through the other of the apertures.

The first fluid flow control means may comprise sliding plate (or gate) valves or diverter valves and may be dedicated to a single chamber or may be shared by a pair of chambers in a manner known per se.

The aqueous wave generating medium may comprise a separate volume of water for each chamber, a single volume of water for all chambers or a plurality of volume of water each connected to deliver to more than one chamber each such volume being stored in a reservoir elevated with respect of said second fluid control means and having its water contents replenished continuously or intermittently by water drawn off from the pool. Preferably the or each reservoir has a volume of the order of ten times that of the chamber upper portion.

The second passageway means may comprise a single aperture and the pertaining second fluid flow control means may comprise a single closure member or a plurality of closure members. Alternatively the second passageway means may comprise a plurality of apertures and the pertaining second fluid flow control means may comprise a plurality of closure members. In the case where there is a plurality of closure members these may be operated individually to vary the volumetric water delivery rate in the second wave forming effect according to the number of such closure members so operated.

Each closure member may be in the form of a plate member movable into and out of a position blocking delivery of water through the pertaining aperture. It is preferred that when the closure member is positioned to block delivery of water it effects both an aqueous and a pneumatic seal over the aperture. The edge of the aperture may be provided with a rubber-like sealing bead for this purpose. The plate member may be moved into and out of its blocking position by sliding or pivotal motion.

The operating means may be arranged, in said other mode, to apply suction to said one chamber whereby to force-vent the one chamber. The several operating means may be connected to a controller arranged to control the rhythm or pattern of the several operating means so that, for example, all operating means enter the said other mode simultaneously. In an alternative rhythm the several operating means enter the said other mode sequentially. The sequence may be changed from one rythm to another. Pairs of operating means may enter the said other mode simultaneously whilst other pairs of operating means may enter the said other mode sequentially.

It will be understood that the purpose of the operating means entering the said other mode is to deliver to the pool a gigantic or surf-simulating wave and according to the sequencing or rythm of the several operating means the gigantic wave may have a wavefront traversing the whole or part of the width of the plurality of chambers and the wavefront may be essentially linear (when the several operating means simultaneously enter the said other mode) or may be curved either concave or convex with respect to the direction of movement of the wavefront (when the several operating mean enter the said other mode sequentially in pairs). A further possibility is for the wavefront to be either linear or curved but traversing non-orthogonally with respect to the plurality of wave chambers.

Within the capacity limit of the or each reservoir the magnitude of the gigantic or surf-simulating wave is determined in part by the frequency of its delivery and in part by the rate at which the or each reservoir is replenished. A preferred delivery rate is once every ninety seconds. The delivery frequency may be varied, within practical limits set by replenishment of the or each reservoir, by varying the rate of causing the operating means to enter its other mode.

It will further be understood that the purpose of the operating means entering the said one mode is to deliver to the pool frequently occurring low amplitude recreational waves typically having a magnitude of the order of one quarter (or less) that of a gigantic wave. It is preferred that recreational waves are delivered once every three or four seconds. The pattern of the recreational waves may be varied, as is well known, according to the sequence at which pressurised air is delivered to the plurality of chambers. Adjacent chambers may be air pressurised alternately or simultaneously The below-the-water passageway for each chamber is preferably bounded by curved upper and lower guide surfaces each leading from the chamber upper portion and each profiled to provide minimal turbulence in the body of water delivered from the aqueous wave generating medium to the pool. The curved lower guide surface merges into a reefsimulating protruberance formed in the floor of the pool adjacent the outlet of the below-the-water passageway primarily for the purpose of enhancing the quality of the gigantic wave. A further possible source of turbulence in the body of water delivered from the aqueous wave generating medium to the pool is caused by the presence of air in the upper portion of the chamber and to minimise or avoid such turbulence the upper portion of the chamber is vented as previously described during such water delivery.

An embodiment of the present invention will now be described by way of example with reference to the accompanying schematic drawing shown in FIG. 1.

FIG. 1 shows a longitudinal sectional view through a swimming pool provided with apparatus 10 for generating waves in accordance with the present invention. At one end or side of the pool a plurality of wave generating chambers 11 are constructed with adjacent chambers separated by vertical walls 12. Each chamber 11 has a closed upper portion 13 which extends above the quiescent water level 14 of the pool and each chamber communicates with the pool by way of a below-the-water passageway 15. The upper portion 13 of each chamber 11 is provided with a first passageway 16 which is connected by way of a flow control device 17 to a pneumatic wave generator 18. Each upper portion 13 also is provided with a second passageway 19 which is connected by way of a second flow control device 20 to an aqueous wave generator 21. The generator 21 is in the form of a very large volume of water stored in an elevated reservoir 22 and the flow control device 20 is in the form of a plate-like valve member pivotally mounted at axis 23 and actuated by way of chain 24 by a hydraulic ram 25.

The pneumatic generator 18 is in the form of an air blower or fan driven by electric motor 26 and delivering its pressurised air output via ducting 27 containing the flow control device 17. Device 17 is preferably in the form of a pneumatically or hydraulically driven diverter valve enabling either pressurised air to be delivered from generator 18 into chamber 11 or venting of chamber 11, in which case valve 17 can either block off the flow of pressurised air from generator 18 or divert that air flow elsewhere (for example to another chamber 11).

In order to operate the apparatus 10 an operating device 30 is provided which is effectively connected to operate both of the flow control devices 17,19. Device 30 is arranged in one mode to operate flow control device 17 to cause intermittent delivery of pressurised air to the chamber 11 to create a first wave forming effect in the pool whilst simultaneously holding flow control device 19 in its closed position in order to block delivery of water from reservoir 22 to the chamber 11. In another mode operating device 30 operates flow control device 19 to cause delivery of water from the reservoir 22 to the chamber 11 to create a second wave forming effect in the pool whilst simultaneously holding flow control device 17 so as to block delivery of pressurised air to the chamber 11 from the generator 18 while venting the chamber 11 to atmosphere. Venting may be assisted by the application of suction.

Pneumatic generator 18 is provided with its air intake from a machine room or other massive volume of air either internally or externally of the structure in which the pool is formed, whereas reservoir 22 is provided with its water intake by a supply plenum 33 which is supplied with water drawn off from the shallow end of the pool and delivered to the plenum 33 by a water pump 34 with sufficient force to cause delivery of water from plenum 33 vertically up through passageway 35 and into reservoir 22 over a weir 36. Pump 34 may operate either continuously or intermittently.

It will be understood that although the mechanisms for only one chamber 11 have been described in detail each chamber has similar mechanisms and the bank of chambers can be operated in any desired rhythm or sequence by a controller 40 coupled to each of the operating devices 30 so that the pool can be provided with recreational waves of any desired pattern by operation of the various flow control valves 17 and their associated blowers 18 or a gigantic or surf-simulating wave can be formed in the pool by operation of all or any one of the flow control devices 19.

The passageway 15 is particularly formed with upper and lower guide surfaces 15A, 15B, which lead from the upper portion 13 of each chamber 11 in a curved manner to minimise turbulence in the body of water delivered from the reservoir 22 and the lower guide surface 15B merges into a reef simulating protuberance 37 formed in the floor of the pool adjacent the outlet of the passageway 15 for the purpose of enhancing the quality of the gigantic wave. By virtue of the upper portion 13 of the chamber 11 being vented during delivery of water to form a gigantic wave entrapment of air within the gigantic wave forming water is avoided which further minimises undesirable turbulence.

We claim:

1. Apparatus for generating waves in a swimming pool comprises a plurality of wave generating chambers each communicating with the pool through a below-the-water passageway and having a closed upper portion extending above the quiescent water level of the pool, each said upper portion having first passageway means connected via first fluid flow control means to a pneumatic wave-generating medium and second passageway means connected via second fluid flow control means to an aqueous wave generating medium, and operating means connected to said first and second fluid flow control means, said operating means being arranged, in one mode, to cause intermittent delivery of said pneumatic wave-generating medium to one of said chambers to create a first wave-forming effect while simultaneously blocking delivery of said aqueous wave-generating medium to said one chamber and, in another mode, to cause delivery of said aqueous wave-forming medium to said one chamber to create a second wave-forming effect while simultaneously both blocking delivery of said pneumatic wave generating medium to said one chamber and venting said one chamber.

2. Apparatus according to claim 1, wherein the pneumatic wave-generating medium comprises a separate source of pressurised air for each chamber.

3. Apparatus according to claim 1, wherein the first passageway means comprises a single aperture in which case the pertaining first fluid flow control means is adapted to control flow of air both into and out of the chamber via the single aperture.

4. Apparatus according to claim 1, wherein the first passageway means comprises a pair of apertures in which case the first fluid flow control means is adapted to control flow of air into the chamber through one of the apertures and to control flow of air out of the chamber through the other of the apertures.

5. Apparatus according to claim 1, wherein the first fluid flow control means comprises a sliding plate valves dedicated to a single chamber.

6. Apparatus according to claim 1, wherein the aqueous wave-generating medium comprises a separate volume of water for each chamber, each such volume being stored in a reservoir elevated with respect to said second fluid control means and having its water contents replenished by water drawn off from the pool.

7. Apparatus according to claim 6, wherein each reservoir has a volume of the order of ten times that of the chamber upper portion.

8. Apparatus according to claim 1, wherein the second passageway means comprises a single aperture and the pertaining second fluid flow control means comprises a single closure member.

9. Apparatus according to claim 1, wherein the second passageway means comprises a plurality of apertures and the pertaining second fluid flow control means comprises a plurality of closure members.

10. Apparatus according to claim 1, wherein the aqueous wave-generating medium comprises a single source of pressurised air for all chambers.

11. Apparatus according to claim 1, wherein the aqueous wave-generating medium comprises a plurality of sources of pressurised air each connected to deliver to more than one chamber.

12. Apparatus according to claim 1, wherein the first fluid control means comprises diverter valves shared by a pair of chambers.

13. Apparatus according to claim 1, wherein the first fluid control means comprises diverter valves dedicated to a single chamber.

14. Apparatus according to claim 1, wherein the aqueous wave-generating medium comprises a single volume of water for all chambers, such volume being stored in a reservoir elevated with respect to said second fluid control means and having its water contents replenished by water drawn off from the pool.

15. Apparatus according to claim 1, wherein the aqueous wave-generating medium comprises a plurality of volumes of water each connected to deliver to more than one chamber, each such volume being stored in a reservoir elevated with respect to said second fluid control means and having its water contents replenished by water drawn off from the pool.

* * * * *